US011153693B2

(12) United States Patent
Fichtl

(10) Patent No.: US 11,153,693 B2
(45) Date of Patent: Oct. 19, 2021

(54) USER ADJUSTABLE WEIGHTING OF SOUND CLASSES OF A HEARING AID

(71) Applicant: SONOVA AG, Staefa (CH)

(72) Inventor: Elmar Fichtl, Hombrechtikon (CH)

(73) Assignee: Sonova AG, Staefa (CH)

( * ) Notice: Subject to any disclaimer, the term of this patent is extended or adjusted under 35 U.S.C. 154(b) by 67 days.

(21) Appl. No.: 16/608,759

(22) PCT Filed: Apr. 27, 2017

(86) PCT No.: PCT/EP2017/060030
§ 371 (c)(1),
(2) Date: Oct. 25, 2019

(87) PCT Pub. No.: WO2018/196973
PCT Pub. Date: Nov. 1, 2018

(65) Prior Publication Data
US 2020/0204928 A1 Jun. 25, 2020

(51) Int. Cl.
*H04R 25/00* (2006.01)
*G10L 25/51* (2013.01)
*G10L 25/84* (2013.01)

(52) U.S. Cl.
CPC ..... *H04R 25/43* (2013.01); *G10L 25/51* (2013.01); *G10L 25/84* (2013.01); *H04R 25/40* (2013.01); *H04R 25/505* (2013.01); *H04R 25/70* (2013.01); *H04R 2225/41* (2013.01)

(58) Field of Classification Search
CPC ..... H04R 25/43; H04R 25/40; H04R 25/70; H04R 2225/41; H04R 2225/43; H04R 25/50; H04R 25/356; H04R 2225/39; H04R 25/505
USPC ..... 381/312, 314, 320, 313, 317, 56, 23.1, 381/74, 94.1, 107, 106, 57, 71.1, 94.2, 381/102, 103
See application file for complete search history.

(56) References Cited

U.S. PATENT DOCUMENTS

2004/0131195 A1 7/2004 Mergell
2014/0105412 A1* 4/2014 Alves ..... G10K 11/17881 381/71.6

FOREIGN PATENT DOCUMENTS

| | | |
|---|---|---|
| EP | 1404152 | 3/2004 |
| EP | 1858292 | 9/2006 |
| EP | 1858292 | * 11/2007 |
| EP | 2109330 | 10/2009 |

(Continued)

*Primary Examiner* — Norman Yu
(74) *Attorney, Agent, or Firm* — ALG Intellectual Property, LLC

(57) ABSTRACT

A method for operating a hearing aid comprises: acquiring a sound signal; classifying the acquired sound signal with respect to predefined sound classes, wherein a raw class mixing weighting is determined, in which the sound signal is weighted with respect to the sound classes; processing the sound signal with at least one actuator, wherein the actuator processes the sound signal based on an actual actuator parameterization, wherein each sound class comprises a sound class actuator parameterization for each actuator, and the actual actuator parameterization for each actuator is generated by mixing the sound class actuator parameterization of the sound classes based on the raw class mixing weighting; and outputting the processed sound signal to be perceived by the user of the hearing aid.

12 Claims, 4 Drawing Sheets

(56) References Cited

FOREIGN PATENT DOCUMENTS

WO 2015024584 2/2015

* cited by examiner

USER ADJUSTABLE WEIGHTING OF SOUND CLASSES OF A HEARING AID

FIELD OF THE INVENTION

The invention relates to a method, a computer program and a computer-readable medium for operating a hearing aid. Furthermore, the invention relates to a hearing aid.

BACKGROUND OF THE INVENTION

Many hearing aids provide specific settings related to so-called sound classes, i.e. may be adapted to current sound situations. For example, there may be sound classes for hearing speech, listening to music, noisy environment, etc. In general, a sound class may be encoded with a set of configuration parameters for different actuators, wherein an actuator may be seen as a specific method or algorithm for processing the sound signal acquired by the hearing aid. Furthermore, it may be possible that the hearing aid is able to classify the current sound situation and to select the appropriate settings related to the sound class.

Additionally, a mixing of sound classes may be performed by the hearing aid. I.e. depending on the current sound situation, an optimized mixture of appropriate sound classes may be provided, which mixing may provide a better support of the actual hearing demand of the hearing aid user. However, despite of the ability to mix sound classes, a fine-tuning of sound classes may only be performed for only a single sound class. A problem however arises, if a user would like to fine-tune the hearing device, while it is run in mixed mode.

In general, a hearing aid may be fitted into two ways. During conventional fitting, the hearing aid is adjusted in the office of a hearing care specialist and every single actuator setting for the sound class may be fine-tuned and it is assumed, that this fine-tuning provides a sufficient effect also in mixed mode. During self-fitting, the hearing aid may be adjusted by the user of the hearing aid in real life. An approach for self-fitting is to tune sound classes in a mixture of sound classes by equally applying modification to all sound classes being involved in mixing and hoping, that these modifications do not deteriorate other sound types of involved sound classes.

EP 1 404 152 A1 relates to a device and method for fitting a hearing-aid and shows a method for determine sound classes based on individual weighting functions. EP 1 858 292 A1 relates to a method of operating a hearing device and describes a transfer function calculated from similarity factors and base parameters. EP 2 109 330 A1 describes a switching between operational states of a hearing aid incorporating a mixing. WO 2015/024 584 A1 describes a distributed classifier system for a hearing aid.

DESCRIPTION OF THE INVENTION

It is an object of the invention to support fine-tuning of a hearing device running in mixed mode in a smart and satisfying way.

This object is achieved by the subject-matter of the independent claims. Further exemplary embodiments are evident from the dependent claims and the following description.

A first aspect of the invention relates to a method for operating a hearing aid. A hearing aid may be a device, which is adapted for being carried by a user at least partially in or on the ear. In addition, a hearing aid also may be a Cochlear implant device, with parts implanted inside the head. The method may be performed by the hearing aid itself, for example, by a processor of the hearing aid.

According to an embodiment of the invention, the method comprises: acquiring a sound signal, for example with a microphone. It also may be that the hearing aid receives the sound signal via another channel, for example via a radio receiver and/or T-coil. Usually, a sound signal may be an analogue signal, which is digitised for further processing.

According to an embodiment of the invention, the method further comprises: classifying the acquired sound signal with respect to predefined sound classes, wherein a raw class mixing weighting is determined, in which the sound signal is weighted with respect to the sound classes.

In general, a sound class may be seen as specific sound situation, a user of the hearing aid is exposed to. For example, the user may be exposed to noise and to speech. Thus, there may be a sound class for noise and a sound class for speech. The classifying of the acquired sound signal may be performed by determining specific characteristics of the sound signal. For example, speech may be detected when the sound level in a specific frequency range is higher than in the rest of the frequency spectrum of the sound signal. As a further example, noise may be detected, when the sound level of the sound signal is high in the complete frequency spectrum.

The result of the classifying may be a raw class mixing weighting, which for every sound class comprises a weight, which may define how much the respective sound class may be appropriate for helping the user of the hearing aid to better perceive the sound. For example, a weight may be a number between 0 and 1 or a percentage value.

It has to be noted that the configuration settings of sound classes may already have been appropriately fitted in a fitting office for sufficiently good support of a respective sound situation.

According to an embodiment of the invention, the method further comprises: processing the sound signal with at least one actuator, wherein the actuator processes the sound signal based on an actual actuator parameterization, wherein each sound class comprises a sound class actuator parameterization for each actuator, and the actual actuator parameterization for each actuator is generated by mixing the sound class actuator parameterization of the sound classes based on the raw class mixing weighting.

Usually, in the hearing aid, several so-called actuators may be implemented. Every actuator may be seen as a virtual device or algorithm for processing the sound signal. This processing may be done on an actual actuator parameterization. In general, an actuator parameterization may comprise parameterization and/or values, which indicate, how the respective actuator may process the sound signal. For example in a simple case, the actuator parameterization may encode that the actuator is on or off. As a further example, the actuator parameterization may encode how the sound signal is amplified, compressed and/or frequency shifted by the actuator.

Every sound class now comprises sound class actuator parameterizations for one or more actuators, which are applied to the respective actuators, when the respective sound class is used, for example in the case the sound class has been classified by the hearing aid. In the case of mixing of sound classes, the raw class mixing weighting is used for mixing the sound class actuator parameterizations of the identified sound classes. It has to be noted, that a weighting factor may be directly applied to a value of the sound class actuator parameterization. For example, a gain value being present in the sound class actuator parameterization of two different sound classes may be multiplied with the weighting factor of the respective sound classes and the results may be summed up to the gain value that is used in the actual actuator parameterization. However, in general, it is also possible that a value of the actual actuator parameterization depends as a function from the respective weighting factors of the raw class mixing weighting and the respective values of the sound class actuator parameterizations.

According to an embodiment of the invention, the method further comprises: outputting the processed sound signal to be perceived by the user of the hearing aid. It may be that the processed sound signal is output by a loudspeaker. However, it also may be possible that the sound signal is output in other way, for example with a Cochlea implant. Usually, the processed sound signal is a digital signal, which is converted into an analogue signal by a modulator of the hearing aid.

According to an embodiment of the invention, the method further comprises: receiving an adjustment demand for a sound property of a user of the hearing aid; and modifying the raw class mixing weighting into an adjusted class mixing weighting based on the adjustment demand, such that the sound signal is processed with the adjusted class mixing weighting.

It may be seen as a gist of the invention, that not only sound classes but also sound properties are encoded in the hearing aid. A sound property may be characteristics of the sound sensed by the user of the hearing aid, such as intelligibility and/or naturalness of the sound. Whereas sound classes may refer to the sound situation the user is exposed, a sound property may refer to the perception of the user with respect to the sound signal generated by the hearing aid.

The hearing aid now may provide an interface to the user for adjusting a sound property. For example, the user may demand that the sound produced by the hearing aid should be more intelligible. Such an interface may comprise a knob on the hearing aid and/or may be provided by the user interface of an application of a mobile device that is communicatively interconnected with the hearing aid.

The sound classes implemented in the hearing aid may be associated with the sound property. For example, it may be encoded, that a sound class is positively correlated with the sound property, that a sound class is negatively correlated with the sound property and/or that a sound class is not correlated with the sound property. A correlation of a sound property with sound classes may be used to modify the raw class mixing weighting according to the demand of the user of the hearing aid. For example, the weighting factor of a sound class positively correlated with the sound property may be increased and/or the weighting factor of a sound class negatively correlated with the sound property may be decreased.

In such a way, a user of the hearing aid may adjust a ratio of sound classes in a mode of the hearing aid, in which sound classes are mixed. For example, there may be the sound classes "Speech in Noise", "Comfort in Noise" and "Calm Situation". The sound class "Speech in Noise" may be positively correlated with the intelligibility. If more intelligibility is requested by the user, the weighting factor of "Speech in Noise" may be increased.

With the method, a lot of hearing issues occurring in sound situations, which trigger the hearing aid to run in mixed mode, may be solved by adjusting this weighting or ratio of sound classes in mixed mode. Users of hearing aids may themselves fine-tune their hearing devices during their daily usage. With the method, fine-tuning of hearing aids in mixed mode may be supported and therefore a fit-ability of their hearing devices in real life may be improved. Hearing care specialists and users may fine-tune hearing devices in a more controlled way, such that unexpected or unwanted results may be avoided. Users may become enabled to fine-tune their hearing devices by self-fitting in a more traceable way while they use them in real life.

According to an embodiment of the invention, the adjustment demand and/or the adjusted class mixing weighting is stored with respect to the raw class mixing weighting as reference. When a raw class mixing weighting used as a reference is determined during classification of the sound signal, the sound signal may be processed with the adjusted class mixing weighting stored with respect to the reference. The hearing aid may store, when a user has demanded to adjust the current class mixing. The adjustment demand and/or the adjusted class mixing weighting may be stored with respect to the current sound situation and/or current class mixing.

In such a way, when the classification of the sound signal results in a specific raw class mixing weighting, the hearing aid may search for a previous user adjustment with respect to the sound classification, i.e. with respect to the raw class mixing weighting. When such previous user adjustment is found, the hearing aid may automatically adjust the class mixing weighting accordingly.

According to an embodiment of the invention, when a raw class mixing weighting is determined during classification of the sound signal, which differs from a reference only by at least a threshold, the adjusted class mixing weighting stored with respect to the reference is used for processing the sound signal. The decision to use an adjusted class mixing weighting may be based on comparing the actual classification and/or raw class mixing weighting with a previous classification and/or raw class mixing weighting with the aid of a distance function. When this distance becomes smaller than a threshold, then the adjusted class mixing weighting may be used. In such a way, a user adjustment may not or only to a very small extent affect other sound situations. Furthermore, the effect of an adjustment may be locally limited to a small area of similar classifications.

According to an embodiment of the invention, the class mixing weighting comprises a weighting factor for each sound class and the actuator parameterization for an actuator is determined by applying the weighting factors to the sound class actuator parameterization of the sound classes. As already mentioned, in general, the adjustment of a parameter of the actual actuator parameterization may depend on a function of the weighting factors of the sound classes and the corresponding parameters stored in the sound class actuator parameterizations.

According to an embodiment of the invention, the adjustment demand for a sound property is a demand for increasing or decreasing the sound property. For example, the user may increase or decrease the sound property of a slider or knob. It also may be possible that sound properties may be adjusted in a more complicated way, for example by choosing a point in a two-dimensional parameter room.

According to an embodiment of the invention, the sound property is associated with a sound class, such that a demand for increasing the sound property results in a higher weighting of the sound class. As already mentioned, the sound property may be positively correlated with the sound class. Analogously, the sound property may be associated with a sound class, such that a demand for increasing the sound property results in a lower weighting of the sound class, i.e. the sound property may be negatively correlated with the sound class.

According to an embodiment of the invention, an actuator may be a gain actuator again. A gain actuator may apply again a model to the sound signal. Such a gain model may amplify and/or may compress the sound signal in a frequency dependent way.

According to an embodiment of the invention, an actuator may be a directionality actuator. A directionality actuator may be based on a beam forming model. For example, a directionality actuator may be applied to a hearing aid with more than one microphone. In this context, it has to be noted that a hearing aid may comprise a device for every ear of the user. With a sound signal provided by more than one microphone, sound from a specific direction may be amplified and/or may be damped.

According to an embodiment of the invention, an actuator may be a sound cleaning actuator. With a sound cleaning actuator, background noise may be cleaned from the sound signal. For example, frequencies below a specific sound level and/or in a specific frequency range may be damped.

According to an embodiment of the invention, the sound classes are selected from: speech in noise, comfort in noise, calm situation, and/or music. Further to these sound classes other classifications might be used, such as "soft sound", "loud sound", "reverberant sound", "car" or the like might be applied. The sound class "speech in noise" may comprise an actuator parameterization, which results in damping noise and amplifying speech. The sound class "comfort in noise" may comprise an actuator parameterization, which results in damping noise, while not modifying other sound components. The sound class "calm situation" may comprise an actuator parameterization, which results in amplifying quiet sounds not generating white noise. The sound class "music" may comprise an actuator parameterization, which does not apply compression or additionally modify spectral properties of the sound.

According to an embodiment of the invention, the adjustment of a sound property is selected from at least one of: intelligibility, comfort, naturalness, clarity, loudness, and/or signal compression. All these sound properties may be correlated with one or more sound classes.

According to an embodiment of the invention, the sound class actuator parameterization for a sound class is fixed with respect to user modifications. The sound class actuator parameterization may have been determined by a hearing care specialist during fitting. This fitted sound class actuator parameterization may be adjusted by a user of the hearing aid by adjusting a sound property.

In the case, the classification of the sound signal results in a raw class mixing weighting near a pure sound class, for example when a weighting factor for a sound class is nearly 1 and the other weighting factors are nearly 0, an adjustment of the raw class mixing weighting may have nearly no effect on the actuators. In this case, an actuator may be directly adjusted based on the adjustment demand by the user of the hearing aid. In other words, if a sound class is dominant due to the mixing, additionally the strengths of respective actuators of a sound class may be adjusted.

According to an embodiment of the invention, an actuator is associated with the sound property of the adjustment demand, and the method further comprises: directly adjusting the actuator parameterization for the actuator based on the adjustment demand, such that the sound signal is processed with the adjusted class mixing weighting and the modified actuator parameterization. As the sound classes, also actuators may be positively or negatively correlated with the sound property. This may mean, that one or more parameters of the actuator parameterization may be increased or decreased, when the sound property is increased or decreased, respectively.

According to an embodiment of the invention, a sound class is associated with an actuator, wherein the actuator parameterization of the actuator is directly adjusted, when a weighting of the sound class in the adjusted class mixing weighting is higher than a threshold. To decide whether an actuator should be directly adjusted, when the classification results in a raw class mixing weighting near a sound class, the respective sound class may be associated with one or more actuators.

It also may be that the adjustment of an actuator is associated with a sound class becomes stronger, when the raw class mixing weighting approaches a sound class and/or becomes weaker, when the raw class mixing weighting moves away from the sound class. For a low weighting of a sound class, the adjustment of the actuators mainly may be performed by modifying the class mixing weighting. For a high weighting of a sound class, mainly the actuator associated with the sound class may be adjusted directly. For weightings in between, a mixture of both adjustment methods may be applied to the actuators.

Further aspects of the invention relates to a computer program for operating a hearing aid, which, when being executed by a processor of the hearing aid, is adapted to carry out the steps of the method as described in the above and in the following, as well as to a computer-readable medium, in which such computer program is stored. A computer-readable medium may be a floppy disk, a hard disk, an USB (Universal Serial Bus) storage device, a RAM (Random Access Memory), a ROM (Read Only Memory), an EPROM (Erasable Programmable Read Only Memory) or a FLASH memory. A computer-readable medium may also be a data communication network, e.g. the Internet, which allows downloading a program code. In general, the computer-readable medium may be a non-transitory or transitory medium.

A further aspect of the invention relates to a hearing aid. It has to be understood that features of the hearing aid as described in the above and in the following may be features of the method, the computer program and the computer-readable medium as described in the above and in the following, and vice versa.

According to an embodiment of the invention, the hearing aid comprises: a classifier for classifying an acquired sound signal with respect to predefined sound classes, wherein a raw class mixing weighting is determined, in which the sound signal is weighted with respect to the sound classes; a sound processor for processing the sound signal with at least one actuator, wherein the actuator processes the sound signal based on an actual actuator parameterization, wherein each sound class comprises a sound class actuator parameterization for each actuator, and the actual actuator parameterization for each actuator is generated by mixing the sound class actuator parameterization of the sound classes based on the raw class mixing weighting; a modulator for outputting the processed sound signal to be perceived by a user of the hearing aid; and a sound property adjuster for generating an adjustment demand for a sound property, when operated by the user of the hearing aid; wherein the hearing aid is adapted for modifying the raw class mixing weighting into an adjusted class mixing weighting based on the adjustment demand, such that the sound signal is processed with the adjusted class mixing weighting.

It has to be noted, that the classifier, the sound processor, the actuators, the modulator and/or the sound property adjuster may be implemented at least partially in hardware or software. These components of the hearing aid also may be modules and/or subroutines of a computer program.

These and other aspects of the invention will be apparent from and elucidated with reference to the embodiments described hereinafter.

BRIEF DESCRIPTION OF THE DRAWINGS

Below, embodiments of the present invention are described in more detail with reference to the attached drawings.

The reference symbols used in the drawings, and their meanings, are listed in summary form in the list of reference symbols. In principle, identical parts are provided with the same reference symbols in the figures.

DETAILED DESCRIPTION OF EXEMPLARY EMBODIMENTS

Figure 1:
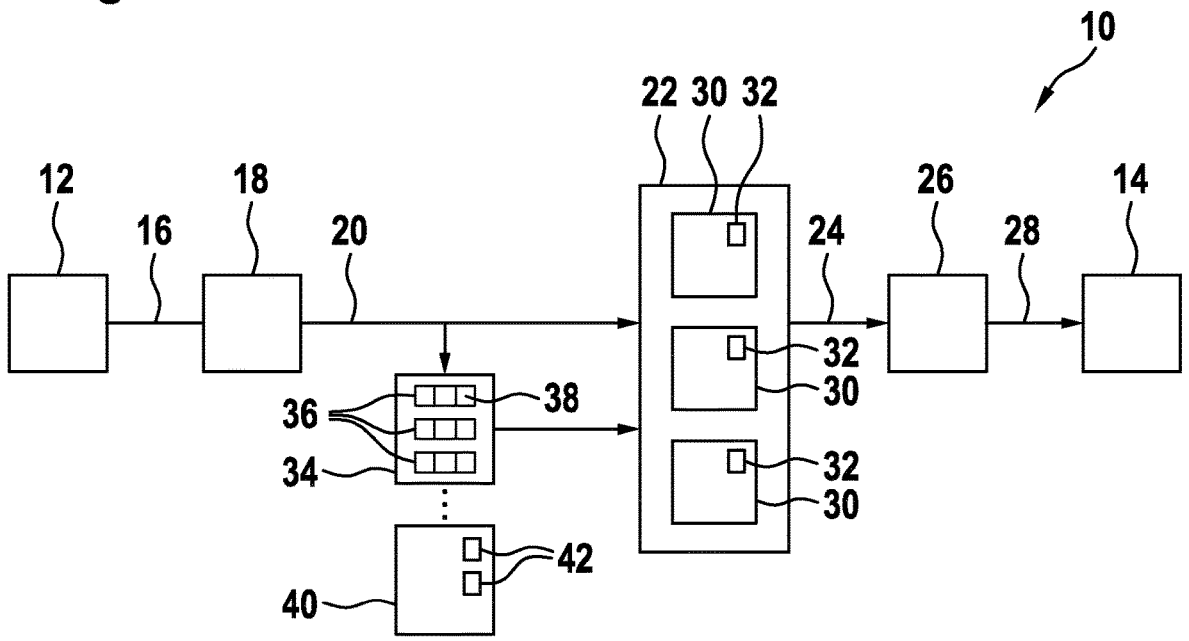
FIG. 1 schematically shows a hearing aid according to an embodiment of the invention.

FIG. 1 schematically shows a hearing aid 10. A hearing aid 10 may be a device that may be put at least partially into an ear of a user to at least partially compensate an auditory defect of the user. In general, a hearing aid 10 may be near the ear, at least partially in the ear channel and/or carried on the ear. It has to be noted that a hearing aid 10 may comprise two separate devices for each ear of the user. It also may be possible that the hearing aid 10 comprises a Cochlear implant, which may be inside the head of the user.

In general, the hearing aid 10 comprises an input 12 for receiving sound data and an output 14 for generating signals stimulating the hearing sense of the user. The input 12 may comprise a microphone and a receiver for sound signals, which may be transferred via infrared, electromagnetic waves and/or cable. For example, a receiver for electromagnetic waves may be a so-called T-coil or telecoil. It is also possible that the input 12 comprises a receiver, which receives digitized sound signals via Bluetooth. The output 14 may comprise a loudspeaker in the ear channel or a stimulation device inside the Cochlear.

An analogue signal 16 from the input 12 may be transformed by a demodulator 18 into a digital sound signal 20. For example, a microphone and/or T-coil may generate analogue sound signals, which may be then transformed into a digital sound signal 20 or sound data 20. The sound signal 20 is then processed by a sound processor 22, which produces a processed sound signal 24. The processed sound signal 24, which may be a digital signal, is then transformed by a modulator 26 into an analogue output signal 28, which then may be output by the output 14.

The sound processor 22 comprises actuators 30, which are adapted for processing the sound signal 20 into the sound signal 24. The actuators 30 may be adapted for processing the sound signal 20 in series and are in parallel, which may mean that the sound signal 20 processed by one of the actuators 30 is input into another one of the actuators 30. For example, the actuators 30 may comprise a gain actuator, a directionality actuator, a sound cleaning actuator, etc.

Each of the actuators 30 comprises an actual actuator parameterization 32. With its actuator parameterization 32, an actuator 30 may be adjusted, how it processes the sound signal 20. For example, in the case of a directionality actuator, the actuator parameterization 32 may comprise an angle which defines the range in which the sound signal is amplified and outside of which the sound signal is damped. As a further example, in the case of a sound cleaning actuator, the actuator parameterization 32 may comprise a frequency above which noise is damped.

The actual actuator parameterization 32 of the actuators 30 may be set by a classifier 34, which is adapted for classifying the sound signal 20 according to different sound classes 36. Examples for sound classes 36 are "speech in noise", "comfort in noise", "calm situation", "music", etc.

The classifier 34 analyses the current sound signal 20 and determines, which sound class 36 is best used with respect to the current sound signal 20. When a sound class 36 has been determined by the classifier 34, the actual actuator parameterizations 32 of the actuators 30 are adapted to the determined sound class 36. To this end, each sound class 36 comprises sound class actuator parameterizations 38 for some or all of the actuators 30. The sound class actuator parameterizations 38 are applied to the actuators 30.

The sound class actuator parameterization 38 for the sound class 36 may be fixed with respect to user modifications. I.e. a user of the hearing aid 10 may not be able to modify the sound classes 36 as well as the sound class actuator parameterizations 38. The sound class actuator parameterization 38 may be modified and/or fitted by a professional hear care specialist during a professional fitting of the hearing aid 10.

It is possible, that the hearing aid 10 and in particular the classifier 34 are operated in a mixed mode. In the mixed mode, not only one but several of the sound classes 36 may be determined as relevant. The classifier 34 may assign every sound class 36 a weighting factor, which indicates the relevance of the sound class 20 with respect to the current sound signal 20. The actual actuator parameterizations 32 are then set based on the weighting factors and the sound class actuator parameterization 38. In other words, the sound classes 36 are applied in a mixed way to the actuators 30.

FIG. 1 furthermore shows a sound property adjuster 40, with which a user of the hearing aid 10 can adjust the mixing of the sound classes 36, as will be described with reference to the following figures. For example, the sound property adjuster 40 may comprise a knob on the hearing aid 10 and/or may comprise a slider or similar virtual control element in the user interface of an application that may be run on a mobile device that is communicatively interconnected with the hearing aid 10. With the sound property adjuster 40, one or more sound properties 42 may be adjusted, which influence the mixing of the sound classes 36. Examples for sound properties 42 may be intelligibility, comfort, naturalness, clarity, loudness, signal compression, etc.

It has to be noted that the modules 18, 22, 26, 30, 34, 40 may be implemented as software modules of a computer program running in the hearing aid 10 and/or further devices, such as the mobile device mentioned above.

Figure 2:
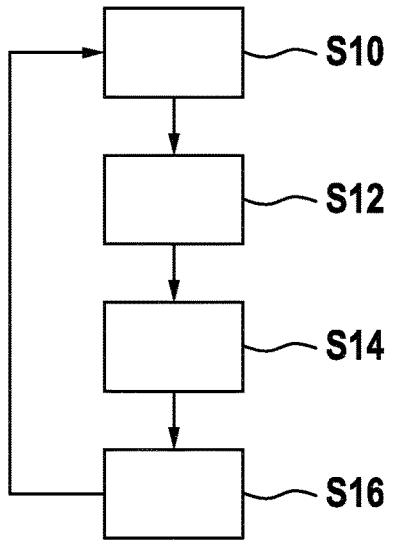
FIG. 2 shows a flow diagram for a method for operating a hearing aid according to an embodiment of the invention.

FIG. 2 shows a method for operating the hearing aid 10, which may be performed by a microprocessor of the hearing aid 10, in which a corresponding computer program is executed. Several steps of the method are illustrated in the following figures.

Figure 3:
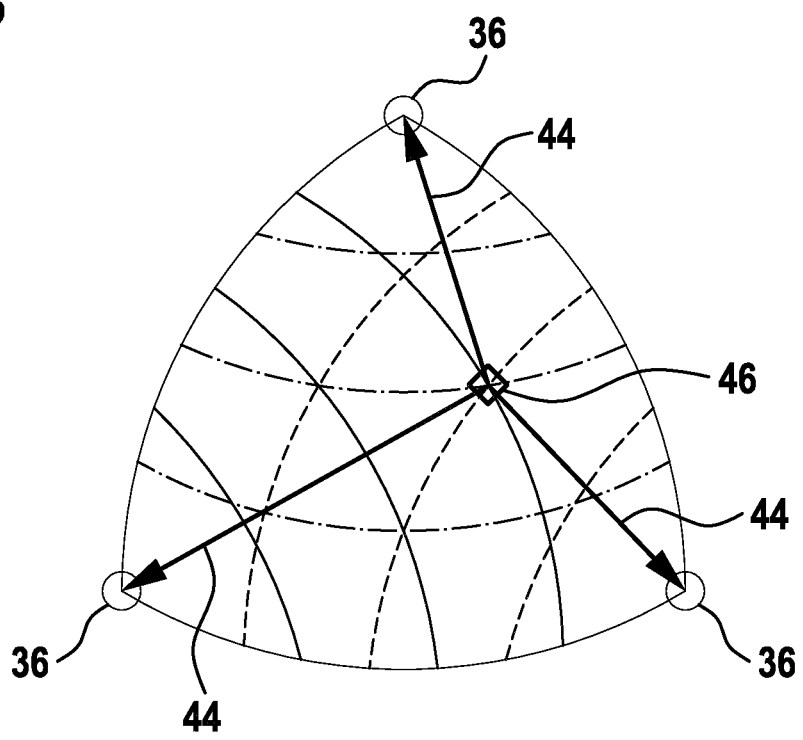
FIGS. 3, 4 and 5 show diagrams illustrating a weighting of sound classes as used in the method of FIG. 2.

FIG. 3 shows a diagram with an example for a space of possible weighting factors 44 for the sound classes 36. In FIG. 3, three sound classes 36 are shown. For example, the upper sound class may be "speech in noise", the left sound class may be "calm situation" and the right sound class may be "comfort in noise".

The weighting factors 44 of sound classes 36, which may be percentage values, may not be independent from each other. This may depend on the type of sound classes. In this case, the pure sound classes 36 may be situated at the corners of the space of possible weighting factors 44, as illustrated in FIG. 3. The circular lines in the space of possible weighting factors 44 indicate equal weightings for the respective sound classes 36.

Returning to FIG. 2, in step S10, the demodulator 18 acquires a sound signal 20 and the classifier 34 classifies the acquired sound signal 20 with respect to predefined sound classes 36.

The classifier 34 determines a raw class mixing weighting 46, in which the sound signal 20 is weighted with respect to the sound classes 36. In the example of FIG. 3, "calm situation" is weighted with 20%, while "speech in noise" and "comfort in noise" are weighted with 40%.

The weighting factors 44 may be composed into a raw class mixing weighting 46. In this context, "raw" may refer to a class mixing weighting, which has not yet adjusted by a user of the hearing aid 10.

In step S12, the actuators 30 are adjusted according to the raw class mixing weighting 46 and the sound processor 22 processes the sound signal 20 with the adjusted actuators 30.

Each sound class 36 may comprise a sound class actuator parameterization 38 for each actuator 30, and the actual actuator parameterization 32 for each actuator 30 may be generated by mixing the sound class actuator parameterization 38 of the sound classes 36 based on the raw class mixing weighting 46.

The actual actuator parameterization 32 for the actuators 30 are then determined by applying the weighting factors 44 to the sound class actuator parameterization 38 of the sound classes 36. As already mentioned above, there may be functions and/or routines implemented in the hearing aid 10, which have as input the weighting factors 44 and specific kind of parameters from the sound class actuator parameterization 38, and which output the specific kind of parameters for the actual actuator parameterization 32. An example for such a function may be weighted averaging. An example for such a function may be weight dependent step functions, which turn the actuators 30 on and/or off, when specific weighting factors 44 are passed.

Then, the sound processor 22 processes the sound signal 20 with the actuator 30, wherein the actuator 30 processes the sound signal 20 based on the actual actuator parameterization 32.

After that, the processed sound signal 24 to be perceived by the user of the hearing aid 10 is output by the modulator 26.

Figure 4:
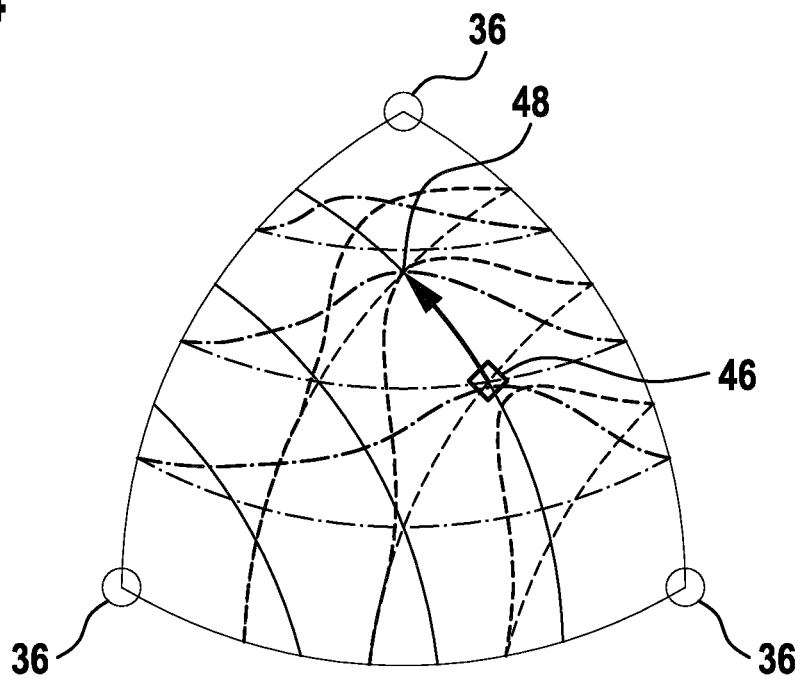

FIG. 4 illustrates, how the raw class mixing weighting 46 may be modified into an adjusted class mixing weighting 48 based on an adjustment demand of the user of the hearing aid 10. As can be seen in FIG. 4, due to the adjustment demand, the weighting factors 44 may be set to different values as in the raw class mixing weighting 46. In FIG. 4, the deformed circular lines in the space of possible weighting factors 44 indicate equal adjusted weightings for the respective sound classes 36.

Returning to FIG. 2, in step S14, the sound property adjuster 40 generates an adjustment demand for a sound property 42 of a user of the hearing aid 10, which sound property 42 is received in the classifier 34. For example, the adjustment demand for a sound property 42 is a demand for increasing or decreasing the sound property 42.

The classifier 34 modifies the raw class mixing weighting 46 into the adjusted class mixing weighting 48 based on the adjustment demand. Each sound property 42 may be associated with one or more sound classes 36. Such an association may indicate a positive or negative correlation of the sound property 42 with the respective sound class 36. In the case of a positive correlation, the corresponding weighting factor 44 may be increased. In the case of a negative correlation, the corresponding weighting factor 44 may be decreased. For example, the sound property 42 may be associated with a sound class 36, such that a demand for increasing the sound property 42 results in a higher weighting of the sound class 36. Analogously, the sound property 42 may be associated with a sound class 36, such that a demand for increasing the sound property 42 results in a lower weighting of the sound class 36.

With respect to FIG. 4, the adjustment demand may be "more intelligibility", which may be implemented by more "speech in noise", i.e. the weighting factor 44 of "speech in noise" may be increased, while the weighting factor of "calm situation" and "comfort in noise" may be decreased. In the example of FIG. 4, "speech in noise" is increased to 75%, while "calm situation" and "comfort in noise" are decreased to 25%.

Later, when the method returns to step S12, the sound signal 20 is processed with the adjusted class mixing weighting 48.

It has to be noted that for combinations or patterns of sound class mixtures, certain predefined sets of modifications may be configured. For example, if soft sounds are too soft, the weighting factor 44 of sound class "calm situations" may be increased. If background noise is too loud, the weighting factor 44 of sound classes "speech in noise" and/or "comfort in noise" may be increased. If intelligibility is still too bad, a beam former strength of sound class "speech in noise" may be increased.

Furthermore, if certain hearing issues occur for all and/or for some sound classes 36, the appropriate modification may become applied to all and/or some of these sound classes 36. A procedure for identifying such cases might be to analyse user control inputs in order to find certain input patterns.

Additionally, psychoacoustic models for loudness, sharpness, intelligibility, etc. may be applied, which may improve derivation of appropriate modifications, i.e. rather "more sound class" or rather "stronger actuator strengths".

The mixing of sound classes 30 as herein described may be combined with other self-fitting procedures, such as loudness control and balance control.

Figure 5:
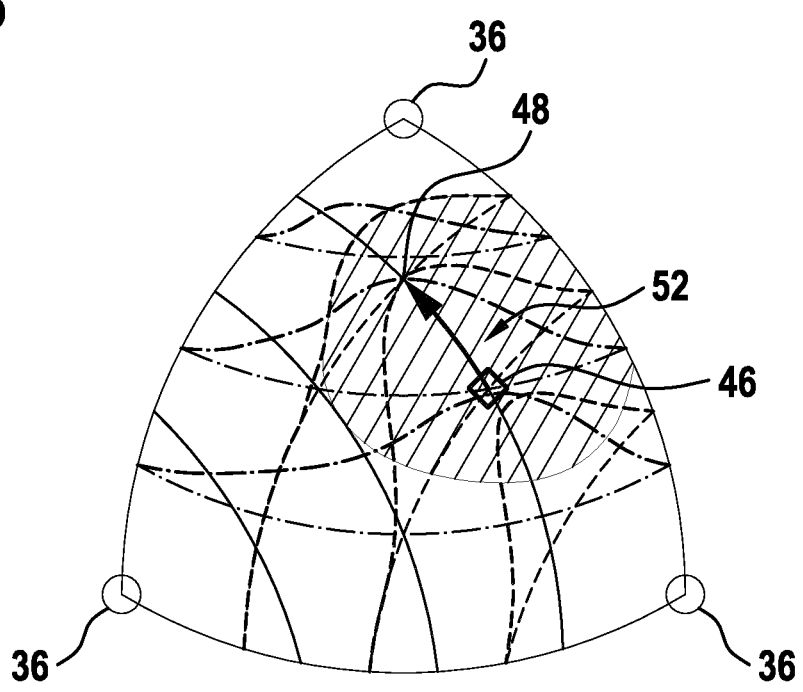

FIG. 5 illustrates that the user modification may be stored in the hearing aid 10 with respect to the space of possible weighting factors 44. For example, the adjustment demand and/or the adjusted class mixing weighting 48 is stored with respect to the raw class mixing weighting 46 as reference. Every time, when the raw class mixing weighting 46, which is determined in step S10, reaches a region 52, in which such a user adjustment has taken place, not the raw class mixing weighting 46 but the adjusted class mixing weighting 48 or an interpolation between these two class mixing weightings 46, 48 is applied in step S12.

In particular with respect to FIG. 2, in step S16, the adjustment demand and/or the adjusted class mixing weighting 48 is stored with respect to the raw class mixing weighting 46 as reference. When a raw class mixing weighting 46 used as a reference is determined during classification of the sound signal 20 in step S10, the sound signal 20 is processed with the adjusted class mixing weighting 48 stored with respect to the reference in step S12.

For example, the region 15 may be determined with a threshold on the distance between the determined raw class mixing weighting 46 and the reference raw class mixing weighting 46 with respect to which a user adjustment has been stored. When a raw class mixing weighting 46 is determined during classification of the sound signal 20 in step S10, which differs from the reference only by at least this threshold, the adjusted class mixing weighting 48 stored with respect to the reference is used for processing the sound signal 20 in step S12.

Figure 6A:
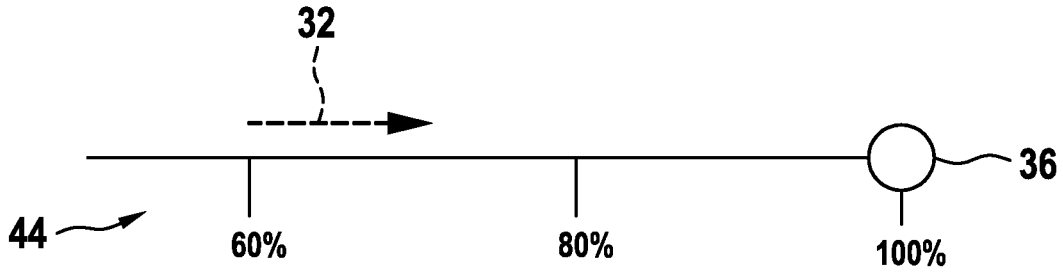
FIGS. 6A, 6B and 6C show diagrams illustrating a weighting of an actuator as used in the method of FIG. 2.
Figure 6B:
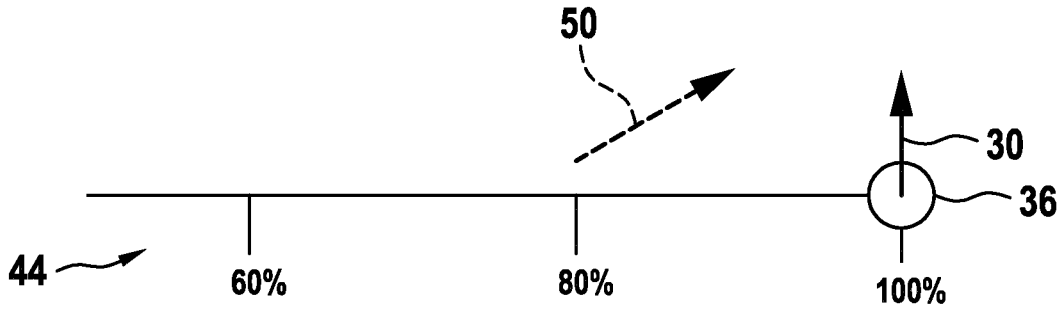

FIG. 6A to 6B illustrate, that not only the weighting of sound classes 36 may be adjusted based on a user demand, but that also an actuator 30 may be directly adjusted. FIG. 6A to 6B show the weighting factor 44 for a sound class 36 and a modified actuator parameterization 50.

An actuator 30 may be associated directly with a sound property 42 and then the user demands an adjustment of sound property 42 not only the class mixing weighting for the sound classes 36 may be adjusted but also the actuator 30 may be adjusted directly.

For example, during step S14, the actuator parameterization 32 for the actuator 30 may be directly adjusted based on the adjustment demand of the user of the hearing aid 10, such that in step S12, the sound signal 20 is processed with the adjusted class mixing weighting 48 and the modified actuator parameterization 50.

Figure 6C:
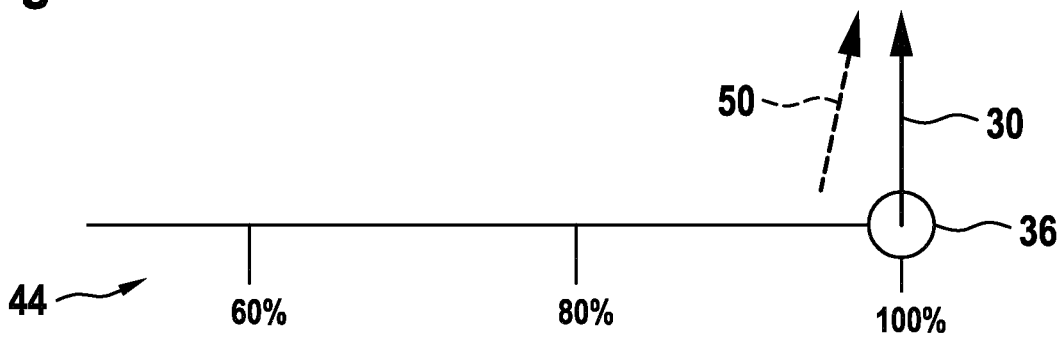

As shown in FIG. 6A to 6C, a sound class 36 may be associated with the actuator 30 and the actuator parameterization 32 of the actuator may be directly adjusted, when a weighting 44 of the sound class in the adjusted class mixing weighting 48 is higher than a threshold. For example, in FIG. 6A, the weighting factor 44 for the sound class 36 is smaller than the threshold and the actuator parameterization 32 is only indirectly adjusted as described above. In the case of FIG. 6B and FIG. 6C, the weighting factor 44 for the sound class is higher than the threshold and the actuator 30 is directly adjusted by additionally modifying the actuator parameterization 32 into the modified actuator parameterization 50.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practising the claimed invention, from a study of the drawings, the disclosure, and the appended claims. In the claims, the word "comprising" does not exclude other elements or steps, and the indefinite article "a" or "an" does not exclude a plurality. A single processor or controller or other unit may fulfil the functions of several items recited in the claims. The mere fact that certain measures are recited in mutually different dependent claims does not indicate that a combination of these measures cannot be used to advantage. Any reference signs in the claims should not be construed as limiting the scope.

LIST OF REFERENCE SYMBOLS

10 hearing aid
12 input, microphone
14 output, loudspeaker
16 analogue input signal
18 demodulator
20 digital sound signal
22 sound processor
24 processed digital output signal
26 modulator
28 analogue output signal
30 actuator
32 actual actuator parameterization
34 classifier
36 sound classes
36 sound class actuator parameterization
38 sound property adjuster
40 sound property
42 weighting factor
46 raw class mixing weighting
48 an adjusted class mixing weighting
50 modified actuator parameterization
52 region

The invention claimed is:

1. A method for operating a hearing aid, the method comprising:

acquiring a sound signal;

classifying the acquired sound signal with respect to predefined sound classes, wherein a raw class mixing weighting is determined, in which the sound signal is weighted with respect to the sound classes;

processing the sound signal with at least one actuator, wherein the actuator processes the sound signal based on an actual actuator parameterization, wherein each sound class comprises a sound class actuator parameterization for each actuator, and the actual actuator parameterization for each actuator is generated by mixing the sound class actuator parameterization of the sound classes based on the raw class mixing weighting;

outputting the processed sound signal to be perceived by a user of the hearing aid;

receiving an adjustment demand for a sound property of the user of the hearing aid;

modifying the raw class mixing weighting into an adjusted class mixing weighting based on the adjustment demand, such that the sound signal is processed with the adjusted class mixing weighting;

storing the adjusted class mixing weighting with respect to the raw class mixing weighting as reference raw class mixing weighting;

determining a further raw class mixing weighting;

when the further raw class mixing weighting differs from the reference raw class mixing weighting only by at least a threshold, processing the sound signal with the adjusted class mixing weighting stored with respect to the reference raw class mixing weighting.

2. The method of claim 1, wherein the raw class mixing weighting comprises a weighting factor for each sound class and the actual actuator parameterization for an actuator is determined by applying the weighting factors to the sound class actuator parameterization of the sound classes.

3. The method of claim 1, wherein the adjustment demand for a sound property is a demand for increasing or decreasing the sound property.

4. The method of claim 1, wherein the sound property is associated with a sound class, such that a demand for increasing the sound property results in a higher weighting of the sound class; and/or wherein the sound property is associated with a sound class, such that a demand for increasing the sound property results in a lower weighting of the sound class.

5. The method of claim 1, wherein the at least one actuator is selected from:

a gain actuator, a directionality actuator, a sound cleaning actuator.

6. The method of claim 1, wherein the sound classes are selected from:

speech in noise, comfort in noise, calm situation, music.

7. The method of claim 1, wherein the sound property is selected from at least one of:

intelligibility, comfort, naturalness, clarity, loudness, signal compression.

8. The method of claim 1, wherein the sound class actuator parameterization for a sound class is fixed with respect to user modifications.

9. The method of claim 1, wherein an actuator is associated with the sound property of the adjustment demand, and the method further comprises:

directly adjusting the actuator parameterization for the actuator based on the adjustment demand, such that the sound signal is processed with the adjusted class mixing weighting and the modified actuator parameterization.

10. The method of claim 1, wherein a sound class is associated with an actuator;

wherein the actuator parameterization of the actuator is directly adjusted, when a weighting of the sound class in the adjusted class mixing weighting is higher than a threshold.

11. A non-transitory computer-readable medium storing a computer program that, when executed, direct a processor of a hearing aid to:

acquire a sound signal;

classify the acquired sound signal with respect to predefined sound classes, wherein a raw class mixing weighting is determined, in which the sound signal is weighted with respect to the sound classes;

process the sound signal with at least one actuator, wherein the actuator processes the sound signal based on an actual actuator parameterization, wherein each sound class comprises a sound class actuator parameterization for each actuator, and the actual actuator parameterization for each actuator is generated by mixing the sound class actuator parameterization of the sound classes based on the raw class mixing weighting;

output the processed sound signal to be perceived by a user of the hearing aid;

receive an adjustment demand for a sound property of the user of the hearing aid;

modify the raw class mixing weighting into an adjusted class mixing weighting based on the adjustment demand, such that the sound signal is processed with the adjusted class mixing weighting;

store the adjusted class mixing weighting with respect to the raw class mixing weighting as reference raw class mixing weighting;

determine a further raw class mixing weighting;

when the further raw class mixing weighting differs from the reference raw class mixing weighting only by at least a threshold, process the sound signal with the adjusted class mixing weighting stored with respect to the reference raw class mixing weighting.

12. A hearing aid, comprising:

a classifier for classifying an acquired sound signal with respect to predefined sound classes, wherein a raw class mixing weighting is determined, in which the sound signal is weighted with respect to the sound classes;

a sound processor for processing the sound signal with at least one actuator, wherein the actuator processes the sound signal based on an actual actuator parameterization, wherein each sound class comprises a sound class actuator parameterization for each actuator, and the actual actuator parameterization for each actuator is generated by mixing the sound class actuator parameterization of the sound classes based on the raw class mixing weighting;

a modulator for outputting the processed sound signal to be perceived by a user of the hearing aid;

a sound property adjuster for generating an adjustment demand for a sound property, when operated by the user of the hearing aid;

wherein the hearing aid is adapted for modifying the raw class mixing weighting into an adjusted class mixing weighting based on the adjustment demand, such that the sound signal is processed with the adjusted class mixing weighting;

storing the adjusted class mixing weighting with respect to the raw class mixing weighting as reference raw class mixing weighting;

determining a further raw class mixing weighting;

when the further raw class mixing weighting differs from the reference raw class mixing weighting only by at least a threshold, processing the sound signal with the adjusted class mixing weighting stored with respect to the reference raw class mixing weighting.

* * * * *